US005681145A

United States Patent [19]

Neely et al.

[11] Patent Number: 5,681,145

[45] Date of Patent: Oct. 28, 1997

[54] LOW-NOISE, HIGH-EFFICIENCY FAN ASSEMBLY COMBINING UNEQUAL BLADE SPACING ANGLES AND UNEQUAL BLADE SETTING ANGLES

[75] Inventors: Michael J. Neely, Dayton; Michael Brendel, Centerville; John R. Savage, Kettering, all of Ohio

[73] Assignee: ITT Automotive Electrical Systems, Inc., Auburn Hills, Mich.

[21] Appl. No.: 739,944

[22] Filed: Oct. 30, 1996

[51] Int. Cl.[6] ..... F04D 29/38

[52] U.S. Cl. ..... 416/203; 416/223 R; 415/119

[58] Field of Search ..... 415/195, 119; 416/223 R, 169 A, DIG. 2, 203

[56] References Cited

U.S. PATENT DOCUMENTS 4,253,800 3/1981 Segawa et al. ..... 416/203
4,358,245 11/1982 Gray ..... 416/189

(List continued on next page.)

FOREIGN PATENT DOCUMENTS 4326147 11/1994 Germany .

OTHER PUBLICATIONS

Mellin, R.C., and Sovran, G., "Controlling the Tonal Characteristics of the Aerodynamic Noise Generated by Fan Rotors," Journal of Basic Engineering, Mar. 1970, pp. 143–154.

Akaike et al., "Rotational Noise Analysis and Prediction for an Axial Fan with Unequal Blade Pitches," Presented at International Gas Turbine and Aeroengine Congress Exposition, The Hague, Netherlands, Jun. 16, 1994, ASME Paper 94–GT–356.

Fiagbedzi, Y.A., "Reduction of Blade Passage Tone by Angle Modulation," Journal of Sound and Vibration, 1982, 82(1), 119–129.

Drela, M., and Youngren, H., "MISES viscous/inviscid multiple blade cascade analysis/design system," version 2.1, Jun. 1995, Massachusetts Institute of Technology Computational Aerospace Sciences Laboratory.

Mellin, R.C., "Determination of Overall and Perceived Noise Level and Their Use in The Selection of an Axial–Fan Design," General Motors Research Laboratories Report No. ED–144, Aug. 4, 1996.

Mellin, R.C., "Determination of Least Radical Unequally Speed Fan–Blading Arrangements for Whitest Noise with Any Number of Blades," General Motors Research Laboratories Report No. ED–118, Apr. 4, 1966.

Mellin, R.C., "Most–Effective Balanced Circumferential Blade Spacings for Fans with Eight Blades or Less," General Motors Research Laboratories Report No. ED–216, Oct. 3, 1967.

Mellin, R.C., "Least–Radical Effective Balanced Circumferential Blade Spacings for Fans with Any Number of Blades," General Motors Research Laboratories Report No. ED–273, Sep. 25, 1968.a.

*Primary Examiner*—John T. Kwon
*Attorney, Agent, or Firm*—Thomas N. Twomey; J. Gordon Lewis

[57] ABSTRACT

A vehicle engine-cooling fan assembly for circulating air to cool an engine. The fan assembly has a central hub with a plurality of blades extending radially outward from the central hub. Each blade has a root joined to the central hub, a tip, and a span formed between the root and the tip. The blades are spaced circumferentially from each other, by unequal spacing angles, around the central hub. The unequal spacing angles minimize noise produced by the fan assembly. The blades are positioned at a radial location along a blade span by unequal setting angles which increase the efficiency of the fan assembly. The blades can have either a straight or a curved planform. Mechanical energy is imparted to the fan assembly from an electric motor, a hydraulic motor, or some other source. Also disclosed is a process for designing a vehicle fan assembly combining unequal fan blade spacing angles and unequal fan blade setting angles.

10 Claims, 11 Drawing Sheets

U.S. PATENT DOCUMENTS

| | | | |
|---|---|---|---|
| 4,474,534 | 10/1984 | Thode | 416/203 |
| 4,569,632 | 2/1986 | Gray, III | 416/DIG. 2 |
| 4,840,541 | 6/1989 | Sakane et al. | 416/223 R |
| 5,000,660 | 3/1991 | Van Houten et al. . | |
| 5,320,493 | 6/1994 | Shih et al. | 416/223 R |
| 5,342,167 | 8/1994 | Rosseau | 415/119 |
| 5,513,951 | 5/1996 | Komoda et al. | 416/223 R |

LOW-NOISE, HIGH-EFFICIENCY FAN ASSEMBLY COMBINING UNEQUAL BLADE SPACING ANGLES AND UNEQUAL BLADE SETTING ANGLES

FIELD OF THE INVENTION

This invention relates generally to a vehicle engine-cooling fan assembly and, more particularly, to the spacing and setting angles of the fan blades of such an assembly. The combination of unequal fan blade spacing angles and unequal fan blade setting angles reduces the tonal characteristic of the fan noise while achieving substantially uniform blade loading and, therefore, increased fan efficiency.

BACKGROUND OF THE INVENTION

Referring to the drawing, it is emphasized that, according to common practice, the various features of the drawing are not to scale. On the contrary, the width or length and thickness of the various features are arbitrarily expanded or reduced for clarity. A multi-bladed cooling air fan assembly 10 is shown in FIG. 1. Designed for use in a land vehicle, fan assembly 10 induces air flow through a radiator to cool the engine. Fan assembly 10 has a hub 12 and may have an outer, rotating ring (not shown) that prevents the passage of recirculating air flow from the outlet to the inlet side of fan assembly 10. A plurality of blades 100 (nine are shown in FIG. 1, labeled 1, 2, 3, 4, 5, 6, 7, 8, and 9) extend radially from hub 12 (where the root 16 of each blade 100 is joined) outward. If fan assembly 10 has a ring, blades 100 extend radially from hub 12 toward the ring where the tip 18 of each blade 100 is joined. Fan assembly 10 rotates in the direction of arrow "R" about an axis 14 that passes through the center of hub 12 and is perpendicular to the plane of fan assembly 10 in FIG. 1.

Fan assembly 10 of FIG. 1 has nine blades 100, although the present invention applies to any fan assembly with greater than three blades. In FIG. 1, blades 100 are equally spaced about the center of hub 12, with equal blade-to-blade spacing angles of 40°. Blades 100 are numbered 1 through 9 in a counter-clockwise direction as viewed from the front of fan assembly 10. Blade Number 1 occupies the 12 o'clock position. Air is pulled through fan assembly 10. As shown in FIG. 1, the air flow direction is into the plane of fan assembly 10.

Each blade 100 of fan assembly 10 has a bottom, or pressure, surface 20 and an upper, or suction, surface 40. See FIG. 2. As fan assembly 10 rotates about axis 14, the mechanical energy imparted to fan assembly 10 (from an electric motor, a hydraulic motor, or some other source) is converted to flow energy. Flow energy is defined as the product of the volumetric flow rate and the pressure rise generated by fan assembly 10. Fan efficiency (eta, $\eta$) is defined as the ratio of flow (or output) energy to input energy.

Fan assembly 10 of FIG. 1 is an axial fan in which an air particle moving through fan assembly 10 traverses a path roughly parallel to the axis of rotation 14. The flow energy produced by fan assembly 10 is proportional to the turning of the air as it passes from the inlet to the outlet plane. This turning is achieved by means of curved, or cambered, blade cross sections. Blades 100 of fan assembly 10 of the present invention may have either a straight or a curved planform. For a discussion of the advantages of a curved planform, see U.S. patent application Ser. No. 08/471,270 filed on Jun. 6, 1995 and rifled "Fan Blade with Curved Planform and High-Lift Airfoil Having Bulbous Leading Edge."

Each fan blade 100 is formed from the blending of several unique airfoil cross sections from hub 12 (or blade root 16) to blade tip 18. As shown in FIG. 2, the airfoil of blade 100 presents an angle of attack (alpha, $\alpha$) with the air stream. The angle of attack is measured relative to the onset velocity, U, of the air stream. The chord of the airfoil is the straight line (represented by the dimension "c") extending directly across the airfoil from the leading edge 60 to the trailing edge 80. The camber of the airfoil of blade 100 is the arching curve (represented by the dimension "a") extending along the center or mean line 50 of the airfoil from leading edge 60 to trailing edge 80. Camber is measured from a line extending between the leading and trailing edges of the airfoil (i.e., the chord length) and mean line 50 of the airfoil.

In the case of a two-dimensional airfoil, the lift generated by the airfoil is a function of the angle of attack and the camber. The lift coefficient, $C_L$, increases linearly with angle of attack until the stall point is reached, as shown in FIG. 3. Increasing the airfoil camber (the curvature of airfoil mean line 50) shifts the $C_{L-\alpha}$ curve to the left; therefore, a cambered airfoil has a positive value of $C_L$ at zero angle of attack.

The airfoil section of fan blade 100 rotates about axis 14 and must be set at such an angle that the desired $C_L$ is produced at the design operating point of fan assembly 10. FIG. 4 shows a radial cross section of blade 100, with the airfoil moving to the left at a velocity $\omega r$. In the blade-relative reference frame (i.e., blade 100 is fixed), the velocity triangle of FIG. 4 comprises an axial velocity, $V_{ax}$, a tangential velocity of the airfoil, $\omega r$, and the resultant of these two, $V_{rel}$. The resultant $V_{rel}$ is the rotating-frame equivalent of the onset velocity, U, of FIG. 2. The angle of attack is the angle between airfoil chord line 90 and $V_{rel}$. The airfoil setting angle (Beta, $\beta$) is the sum of the airfoil angle of attack, $\alpha$, and the angle, $\gamma$, formed by vectors $V_{rel}$ and $\omega r$. Therefore, the setting angle, $\beta$, is the sum $\gamma+\alpha$ as shown in FIG. 4.

The noise produced by an equally spaced blade arrangement such as that illustrated in FIG. 1 is highly tonal. The aerodynamic pressure fields of rotating blades 100, in the presence of a non-uniform inlet flowfield, create unsteady forces that result in noise. This is a different mechanism from the noise generated by turbulent shearing. The turbulence noise is a broadband vortex or "white" noise. Turbulence noise tends not to annoy, provided that the overall sound level is not too high and that the flow remains attached. In contrast, the rotational noise can be very annoying to persons close to fan assembly 10.

Although the annoyance of a particular noise is a matter of subjective evaluation, it can be broadly attributed to either excessive intensity or to a tonal characteristic. Excessive intensity is clearly undesirable. Sounds of even small intensity can annoy, however, if they have a tonal nature which readily distinguishes them from their background noise. The Perceived Noise Level (PNL) of a sound is a subjective criterion for rating the annoyance of a noise. The PNL, measured in perceived noise decibels (PNdB), is defined as the sound-pressure level of a band of noise from 910 to 1090 cycles per second (cps) that sounds as "noisy" as the sound being measured. For additional information about such measurements, see R. Mellin, "Determination of Overall and Perceived Noise Level and Their Use in the Selection of an Axial-Fan Design," General Motors Research Laboratories Report No. ED-144 (Aug. 4, 1966).

A representative predicted spectral distribution for the noise of a fan assembly 10 having equally spaced blades 100 is shown in FIG. 5. In discussing the tones produced by fan assembly 10, certain terms will be used as follows. An harmonic frequency, H, is defined as an integral multiple of shaft speed:

$$H=60f/N.$$

Frequency, f, is in units of Hertz (Hz) and rotational speed, N, is in units of revolutions per minute (rpm). An important term in fan noise analysis is the fundamental tone, which is the harmonic corresponding to the number of fan blades, B. Thus, the fundamental tone occurs when H=B, or f=BN/60. For example, for a nine-blade fan assembly 10 the fundamental tone produced is the 9th harmonic. The 18th and 27th harmonics of that fan assembly are overtones of the fundamental (an overtone is an integer multiple of the fundamental tone). The series of frequencies consisting of the fundamental and its overtones are called orders, O:

$$O=H/B.$$

In the example shown in FIG. 5; the fundamental or first-order tone occurs at 500 Hz. Two overtone harmonics (the second and third-order tones) are also shown. All three tones stand out clearly, in the plot of FIG. 5, above the curve of broadband and background noise. The overtone harmonics have progressively lower magnitudes than the fundamental tone. At an overall Sound Pressure Level (SPL) of 90 dB, the corresponding PNL is calculated as 103 PNdB.

In summary, equally spaced blades 100 generate periodic noise pulses; the spectrum comprises the fundamental plus its harmonics. Such a spectrum has an annoying, highly tonal character. The annoying rotational noise produced by an equally spaced blade arrangement such as that illustrated in FIG. 1 is the motivation for unequal spacing of blades 100. Fan assembly 10 with nine unequally spaced blades 100 is shown in FIG. 6.

Unequally spaced blades 100 generate aperiodic pressure pulses, consisting of the fundamental plus and minus the harmonics of the rotation speed. By unequally spacing blades 100 around the circumference of hub 12, it is possible to alter the noise spectrum and to spread the sound energy to an increasing number of harmonics. This has been known for some time. A common example of its usage is found in the engine-cooling fan assemblies used in automobiles. Unequal blade spacing has been a feature of General Motors automotive engine-cooling fan assemblies for over a decade. The concept was studied extensively at General Motors in the mid-nineteen-sixties, and was presented in a series of General Motors research reports. See, e.g., "Determination of Least Radical Unequally Spaced Fan-Blading Arrangements for Whitest Noise with Any Number of Blades," General Motors Research Laboratories Report No. ED-118 (1966); "Most-Effective Balanced Circumferential Blade Spacings for Fans with Eight Blades or Less," General Motors Research Laboratories Report No. ED-216 (1967); and "Least-Radical Effective Balanced Circumferential Blade Spacings for Fans with Any Number of Blades," General Motors Research Laboratories Report No. ED-273 (1968). Y. Fiagbedzi also confirmed the benefits of unequal blade spacing in "Reduction of Blade Passage Tone by Angle Modulation," J. Sound & Vibration, 82(1), at pages 119–29 (1982).

The effect of unequal blade spacing on the spectral distribution is illustrated in FIG. 7. Unequal blade spacing reduces the amplitude of the fundamental tone while increasing the amplitude of other frequencies in the spectrum (again, relative to the curve of broadband and background noise). The total sound power generated by the fan is not decreased as a result of unequal blade spacing; only the tonality of the spectrum is diminished. Thus, the overall SPL for the spectral distribution of FIG. 7 is the same as that for FIG. 5 (namely, 90 dB). The corresponding PNL for the spectral distribution of FIG. 7 is calculated as 97 PNdB, however, a reduction of 6 PNdB when compared to the spectrum shown in FIG. 5. The PNL is diminished through the reduction in tonality. It is generally agreed that the "white" noise of the unequally spaced blade arrangement shown in FIG. 6 is more pleasing to listeners than the highly tonal spectrum of the comparable equally spaced fan shown in FIG. 1. Calculation of optimum unequally spaced blade angles is discussed by R. Mellin & G. Sovran, in "Controlling the Tonal Characteristics of the Aerodynamic Noise Generated by Fan Rotors," Journal of Basic Engineering, at pages 143–154 (March 1970).

Although unequal spacing of blades 100 around hub 12 of fan assembly 10 improves the noise characteristics of fan assembly 10, such an arrangement of blades 100 produces a corresponding decrease in fan efficiency. This problem was recognized by D. Lohmann in German Published Patent Application No. DE 43 26 147 A1, at page 2, lines 13–17:

> The noises in these fans consist of the whiffing noise and the especially penetrating sound of the fan, whose frequency corresponds to the product of the rotational speed of the fan wheel per second and of the number of blades. A reduction in these noises was achieved in that the blades were arranged unevenly spaced on the hub of the fan wheel. The unpleasant sound of the fan was hereby reduced, but the fluidic conditions were adversely affected.

D. Lohmann then abandoned unequal blade spacing as a way to control fan assembly noise and concentrated instead on blade planform curvature. Although not cited specifically by D. Lohmann, the performance degradation results from unequal loading of fan blades 100. This phenomenon was documented by S. Akaike et al., in "Rotational Noise Analysis and Prediction for an Axial Fan with Unequal Blade Pitches," presented at Intl Gas Turbine & Aeroengine Congress & Exposition, The Hague, Netherlands, ASME Paper 94-GT-356 (June 13–16, 1994) (the term "pitch" as used in the Akaike et al. paper corresponds to the term "spacing" as used in this document).

S. Akaike et al. investigated unequal blade spacing as a way to reduce fan assembly noise. Although recognizing that the conventional, equal blade setting angles also must be selected properly to reduce fan assembly noise (see "Abstract," second paragraph, last line), the authors do not suggest unequal blade setting angles. The authors illustrate, in FIG. 9 of their paper, blade pressure pulses as a function of fan rotation angle. The pressure pulses have unequal magnitudes because the blades have unequal spacing angles and equal setting angles. (This is the precise condition that the present invention corrects.) The authors not only fail to suggest unequal setting angles, they fail even to detect the problem of decreased performance identified and solved by the present inventors; the authors state: "Little deterioration in the performance was caused in the unequally spaced fans compared with that for the equally spaced one." Id. at page 5, right column, last sentence. S. Akaike et al. concluded: "By using unequally space blade fan, the rotational noise components can be flattened and dispersed into more components, resulting in the decrease in the rotational noise of a fan." Id. at page 6.

Fan assembly 10 must accommodate a number of diverse considerations. For example, when fan assembly 10 is used in an automobile, it is placed behind the radiator. Consequently, fan assembly 10 must be compact to meet space limitations in the engine compartment. Fan assembly 10 must also be efficient, avoiding wasted energy which directs air in turbulent flow patterns away from the desired axial flow; relatively quiet; and strong to withstand the considerable loads generated by air flows and centrifugal forces.

To overcome the shortcomings of conventional fan assemblies, a new fan assembly is provided. An object of the present invention is to provide an engine-cooling fan assembly, including a plurality of blades, having operational and air-pumping efficiency. Another object is to reduce the noise created by the fan assembly. Blades produce turning of the air stream through the fan assembly, thereby creating a pressure rise across the assembly. Yet another object of the present invention is to provide a fan assembly in which the fan blades provide high pressure rise across the fan assembly. Finally, it is an object of the present invention to provide a fan assembly design suitable for the entire range of engine-cooling fan assembly operation, including idle, combining the characteristics of reduced fan noise and increased fan efficiency.

SUMMARY OF THE INVENTION

To achieve these and other objects, and in view of its purposes, the present invention provides a vehicle engine-cooling fan assembly for circulating air to cool an engine. The fan assembly has a central hub with a plurality of blades extending radially outward from the central hub. Each blade has a root joined to the central hub, a tip, and a span formed between the root and the tip. The blades are spaced circumferentially from each other, by unequal spacing angles, around the central hub. The unequal spacing angles minimize noise produced by the fan assembly. The blades are positioned at a radial location along a blade span by unequal setting angles which increase the efficiency of the fan assembly. The blades can have either a straight or a curved planform. Mechanical energy is imparted to the fan assembly from an electric motor, a hydraulic motor, or some other source. Also disclosed is a process for designing a vehicle fan assembly combining unequal fan blade spacing angles and unequal fan blade setting angles.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
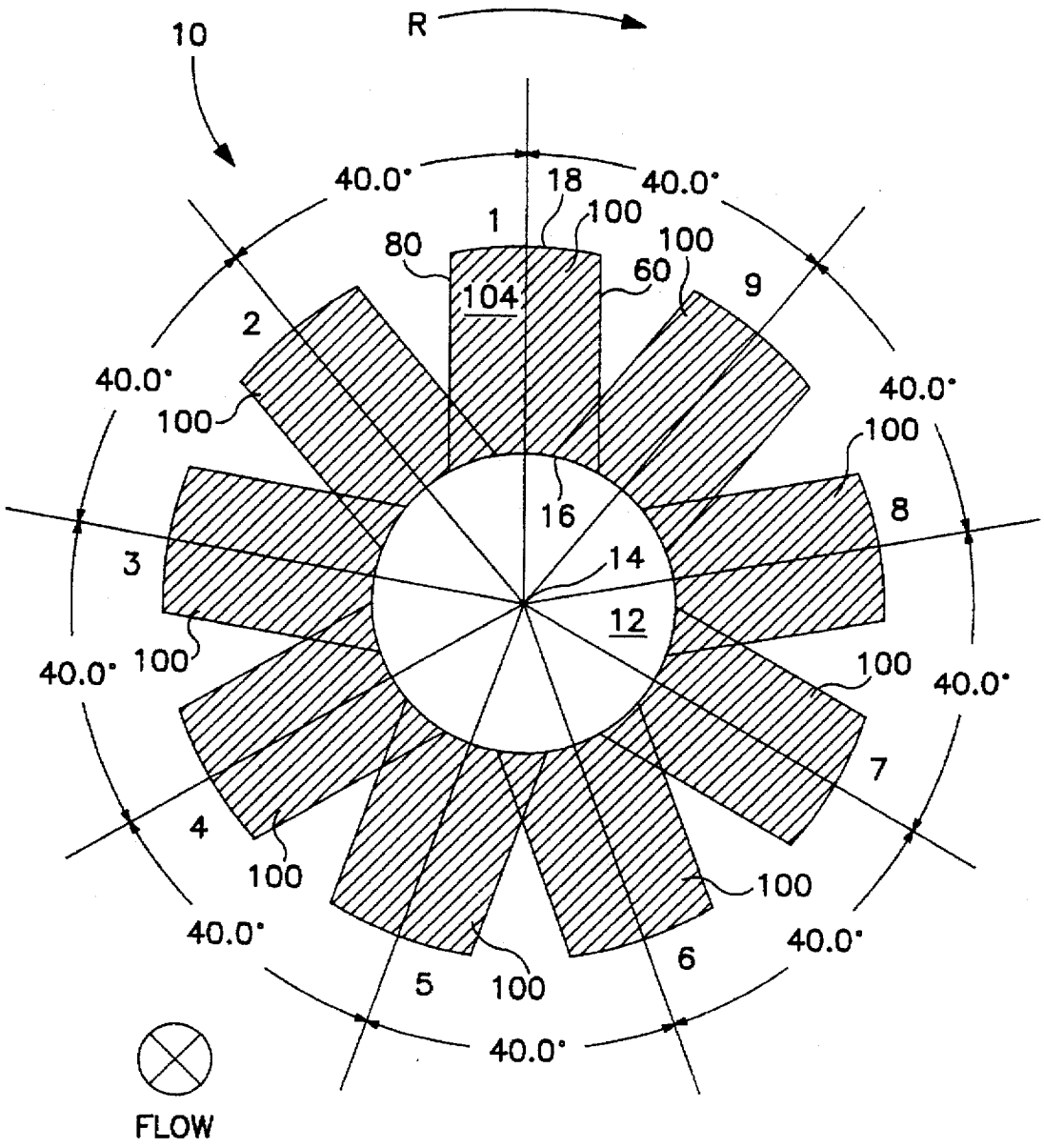
FIG. 1 (PRIOR ART)
FIG. 1 is a cooling air fan assembly having nine, equally spaced blades.
Figure 2:
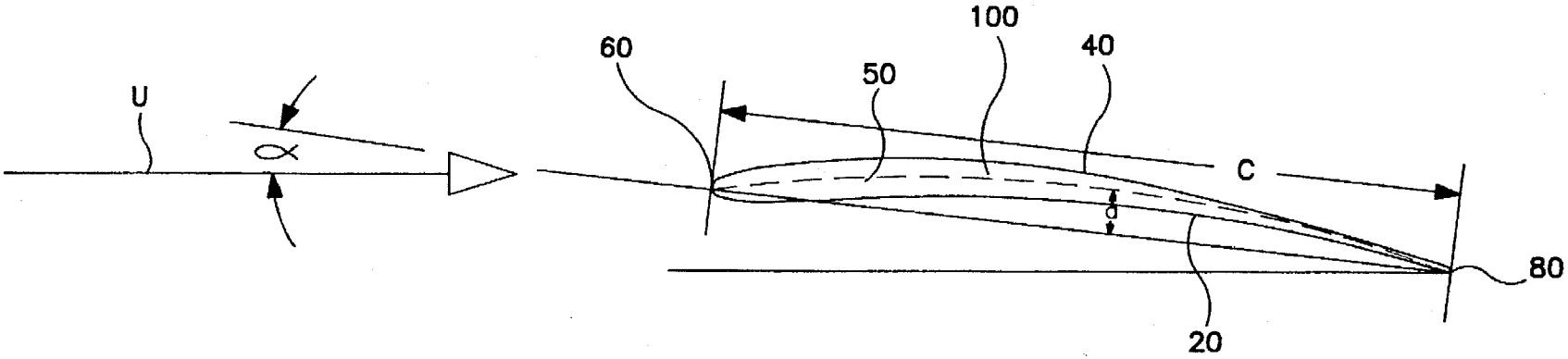
FIG. 2 (PRIOR ART)
FIG. 2 is a cross-sectional view of the airfoil of a blade in an airstream illustrating the angle of attack.
Figure 3:
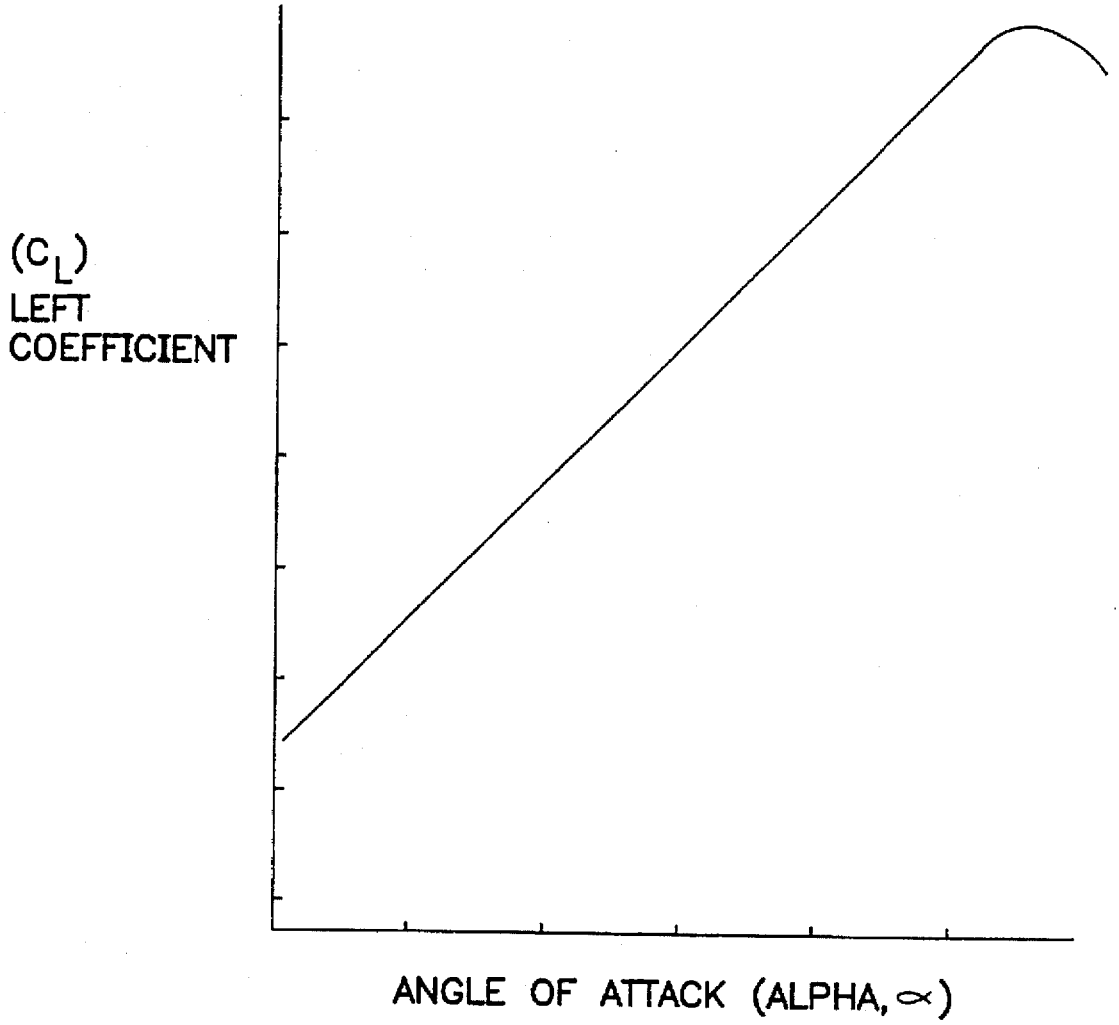
FIG. 3 (PRIOR ART)
FIG. 3 is a graph of Coefficient of Lift ($C_L$) versus Angle of Attack ($\alpha$) for an airfoil.
Figure 8:
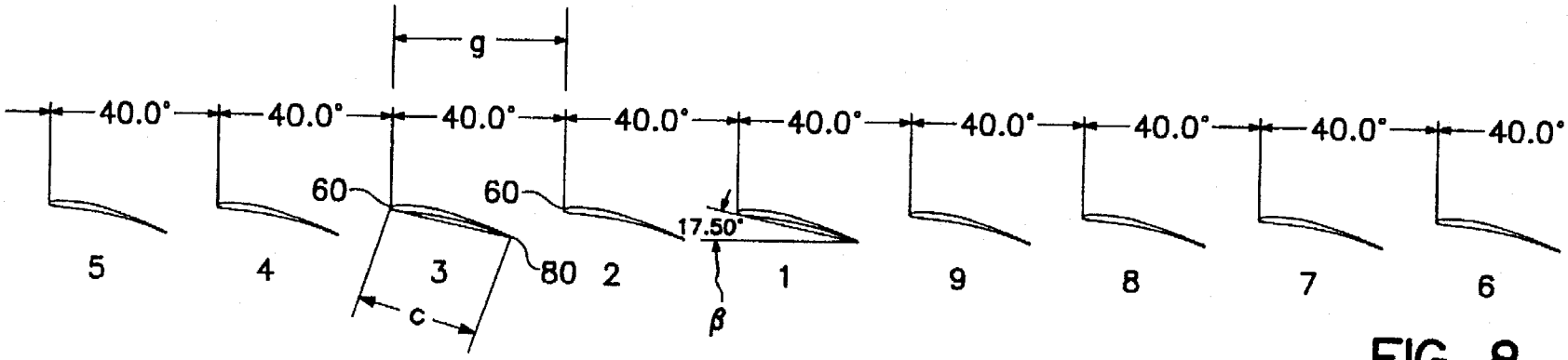
FIG. 8 (PRIOR ART)
FIG. 8 shows nine airfoil sections "unwrapped" from the tip section of the equally spaced fan assembly illustrated in FIG. 1.
Figure 9:
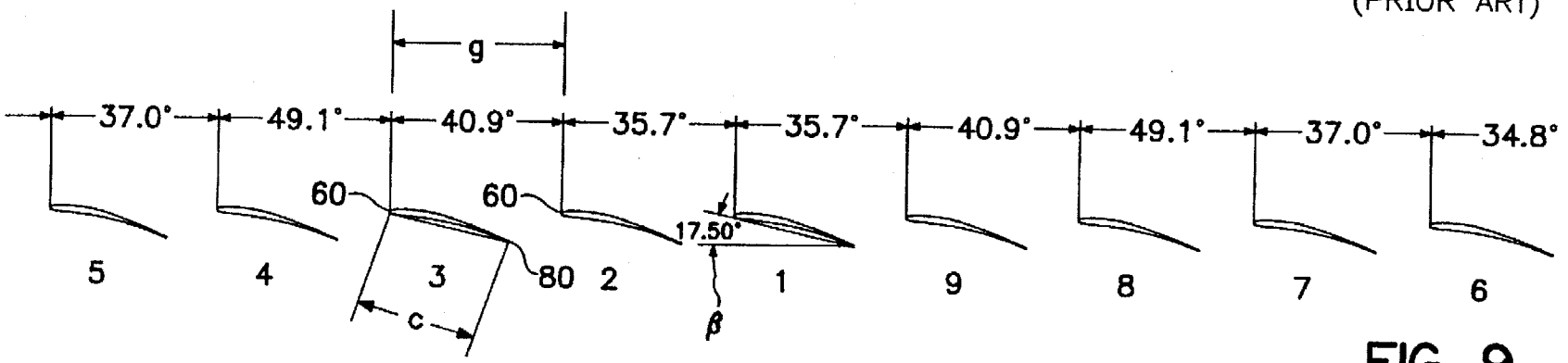
FIG. 9 (PRIOR ART)
FIG. 9 shows nine airfoil sections "unwrapped" from the tip section of the unequally spaced fan assembly illustrated in FIG. 6.

FIG. 8 shows nine airfoil sections "unwrapped" from the tip section of the equally spaced fan assembly 10 illustrated in FIG. 1. FIG. 9 shows nine airfoil sections "unwrapped" from the tip section of the unequally spaced fan assembly 10 illustrated in FIG. 6. Of special importance in fan assembly design is the gap-to-chord ratio, a measure of relative blade-to-blade distance. The gap, g, is the distance from one airfoil leading edge 60 to the leading edge 60 of the adjacent airfoil, along an arc of radius "r." The chord, c, is the distance from the airfoil leading edge 60 to trailing edge 80, measured along an arc. The term "g/c" varies with radius, because the gap, g, increases with increasing radius. In addition, many blades 100 do not have a constant chord from root 16 to tip 18, which also affects the gap-to-chord ratio.

Figure 4:
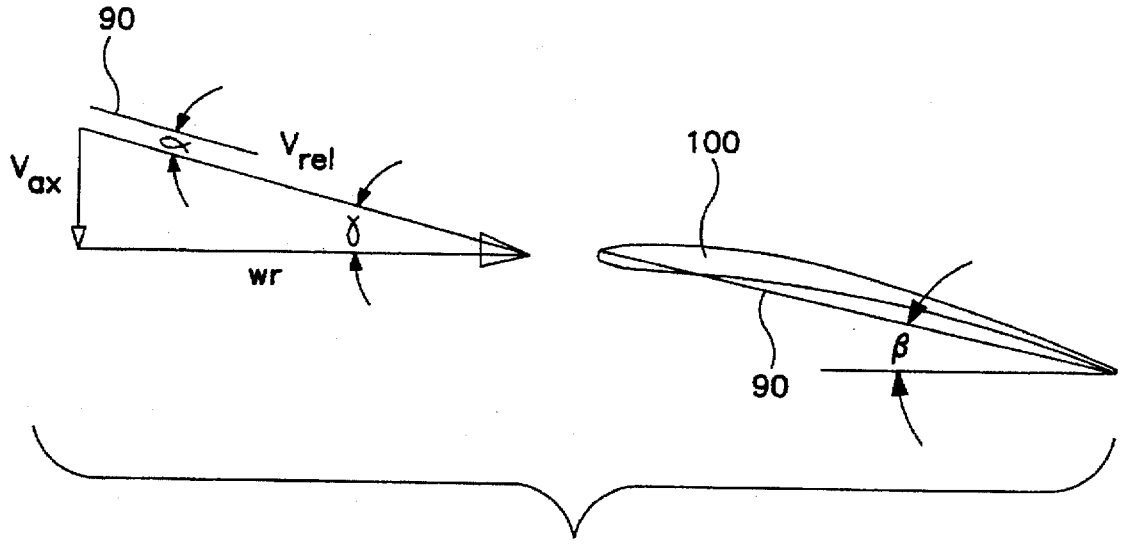
FIG. 4 (PRIOR ART)
FIG. 4 illustrates a typical inlet velocity diagram for an airfoil of a blade, showing the airfoil setting angle ($\beta$)
Figure 5:
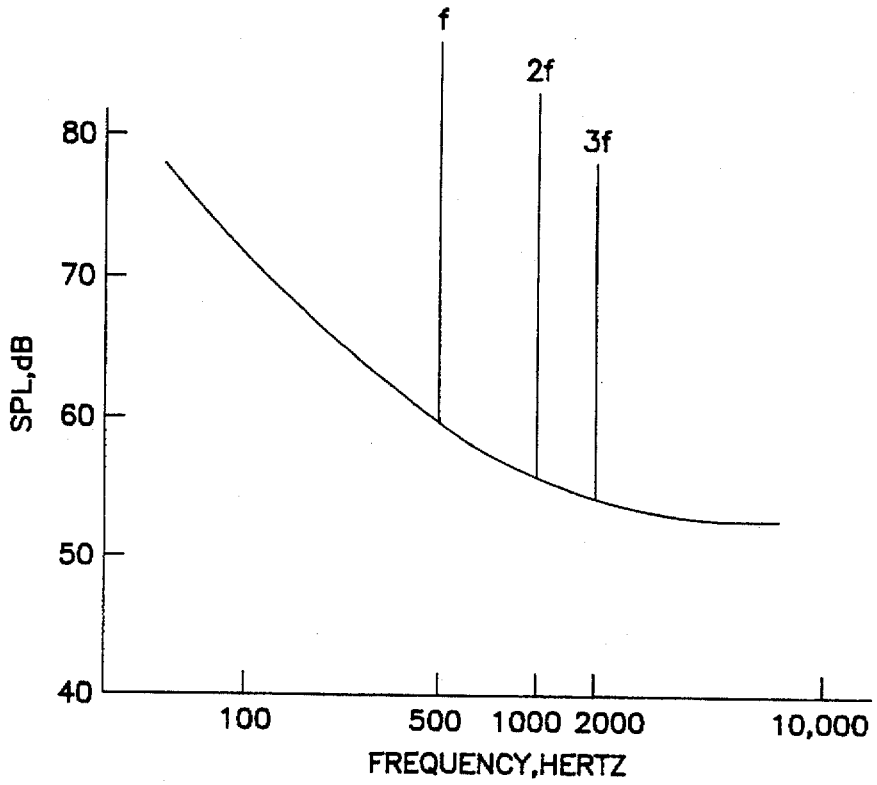
FIG. 5 (PRIOR ART)
FIG. 5 is a representative predicted spectral distribution for the noise of a fan assembly having equally spaced blades as shown in FIG. 1.
Figure 7:
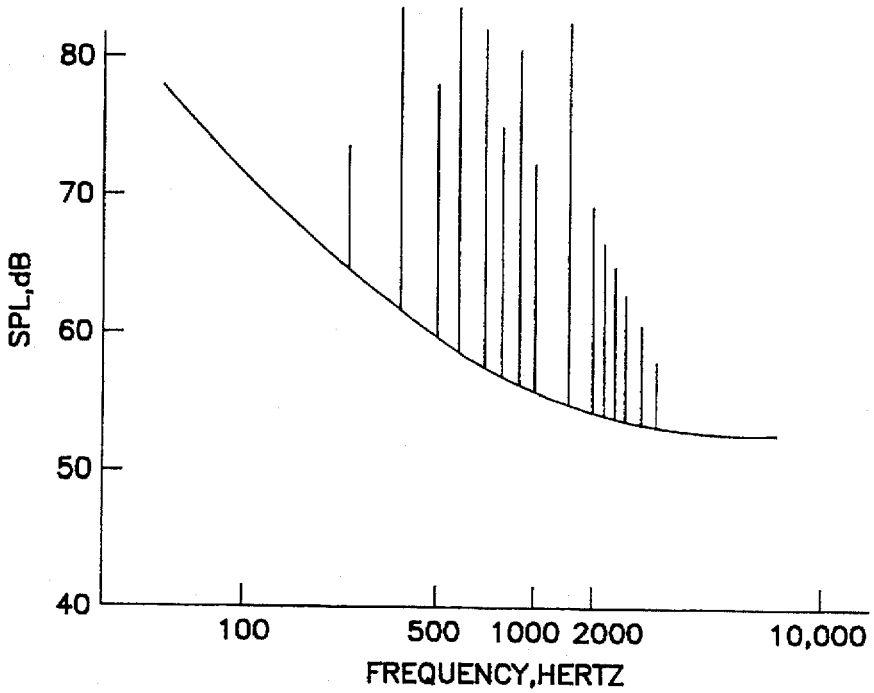
FIG. 7 (PRIOR ART)
FIG. 7 is a representative predicted spectral distribution for the noise of a fan assembly having unequally spaced blades as shown in FIG. 6.

In the conventional fan assembly design procedure, a velocity triangle is calculated for each of several radial stations of fan assembly 10. The hub-to-tip pressure loading is a critical design parameter, and a designer will usually apply a curved distribution of pressure across the span. In general, the highest loading occurs at or above the mid-span location, decreasing to zero at both the root 16 and tip 18. The prescribed pressure loading influences the lift force (and corresponding angle of attack) required for each airfoil. The airfoil setting angle, $\beta$, is the sum of the airfoil angle of attack, $\alpha$, and the relative-velocity angle, $\gamma$, formed by vectors $V_{rel}$ and $\omega r$. Therefore, the setting angle $\beta$ is the sum $\gamma+\alpha$, as shown in FIG. 4. The angle $\beta$ changes with radial station, which explains the "twist" of the blade from tip 18 to root 16.

All of the airfoils shown in FIGS. 8 and 9 have setting angles of 17.5°. In the case of the equally spaced blading of FIG. 8, the equal setting angles produce uniform blade loading and optimum performance. Thus, there is no need to change the setting angles of blades 100 of fan assembly 10 having equally spaced blades 100. The blade arrangement of FIG. 9 will not be uniformly loaded if equal setting angles are used, however, because closely spaced blades will produce forces unequal to those of blades spaced farther apart. Therefore, one drawback of unequal blade spacing is the consequent unequal blade pressure loading. In any turbomachine, the blade airfoils (sections) are designed to efficiently produce lift at a given setting angle.

Furthermore, the angle of attack, α, necessary to produce the design-point lift coefficient, αCL,design, is a function of blade crowding. Blade crowding is expressed as the ratio of airfoil-to-airfoil gap, g, and airfoil chord, c, measured at radius "r." The relationship between αCL,design and gap-to chord ratio, g/c, is presented in FIG. 10. The plot clearly shows that as airfoil spacing (g/c) increases, a larger angle of attack is needed to produce equivalent lift. Therefore, if blades 100 are unequally spaced, the blade setting angles, β, must vary with the blade-to-blade gap to produce equal loading of all blades 100.

Figure 6:
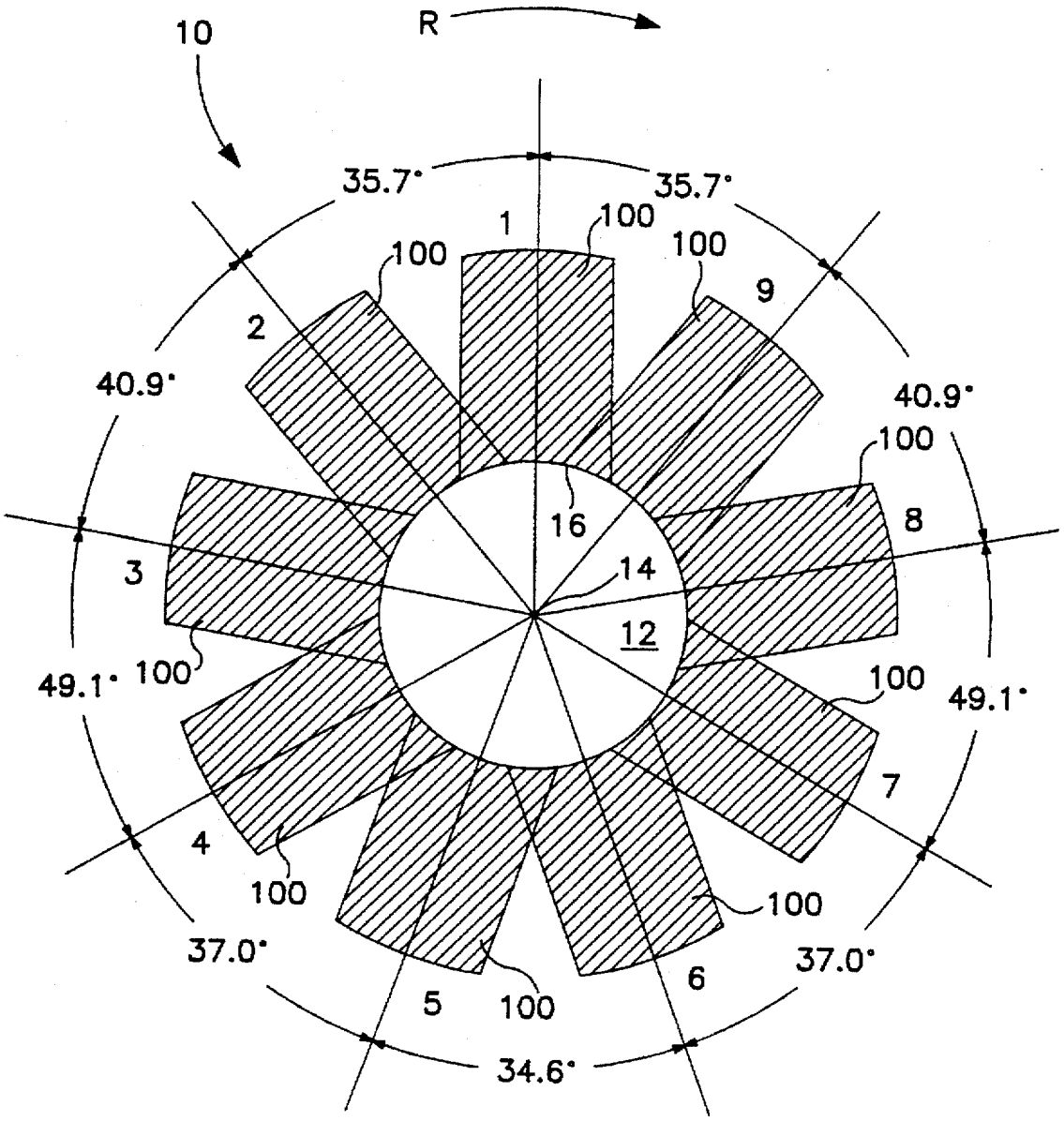
FIG. 6 (PRIOR ART)
FIG. 6 is a cooling air fan assembly having nine, unequally spaced blades.
Figure 11:
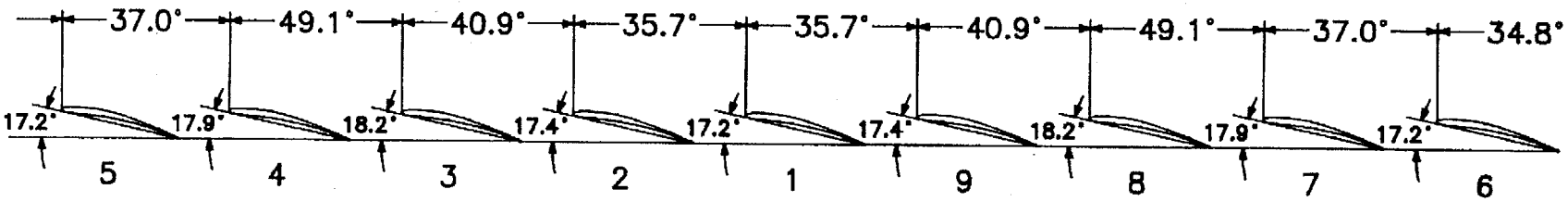
FIG. 11 shows nine airfoil sections "unwrapped" from the tip section of the fan assembly of the present invention having both unequal fan blade spacing angles and unequal fan blade setting angles.

Fan assembly 10 of the present invention is shown in FIG. 11 and incorporates unequal blade spacing angles such as those illustrated in FIGS. 6 and 9. The unequal blade spacing reduces the tonality of the fan noise. Unequal blade spacing results in unequal forces on blades 100, however, which reduces the efficiency of fan assembly 10. By adjusting the airfoil setting angle, β, of each blade 100, based on the relationship between blade loading and the distance between adjacent blades 100, the blade forces are more uniform and the fan efficiency is increased. The two features are related, i.e., the unequal setting angles are a function of the gap between adjacent blades..

Thus, the fan assembly of the present invention has reduced tonality resulting from unequal blade spacing with excellent airflow performance consistent with uniformly loaded fan blades. The uniform loading is achieved by setting each blade 100 to an optimum setting angle, β, based on the relationship between the airfoil angle of attack, α, and the normalized distance between neighboring blades 100. The invention is a fan assembly having unequal blade setting angles, unlike the conventional fan assembly having equal blade setting angles.

Figure 10:
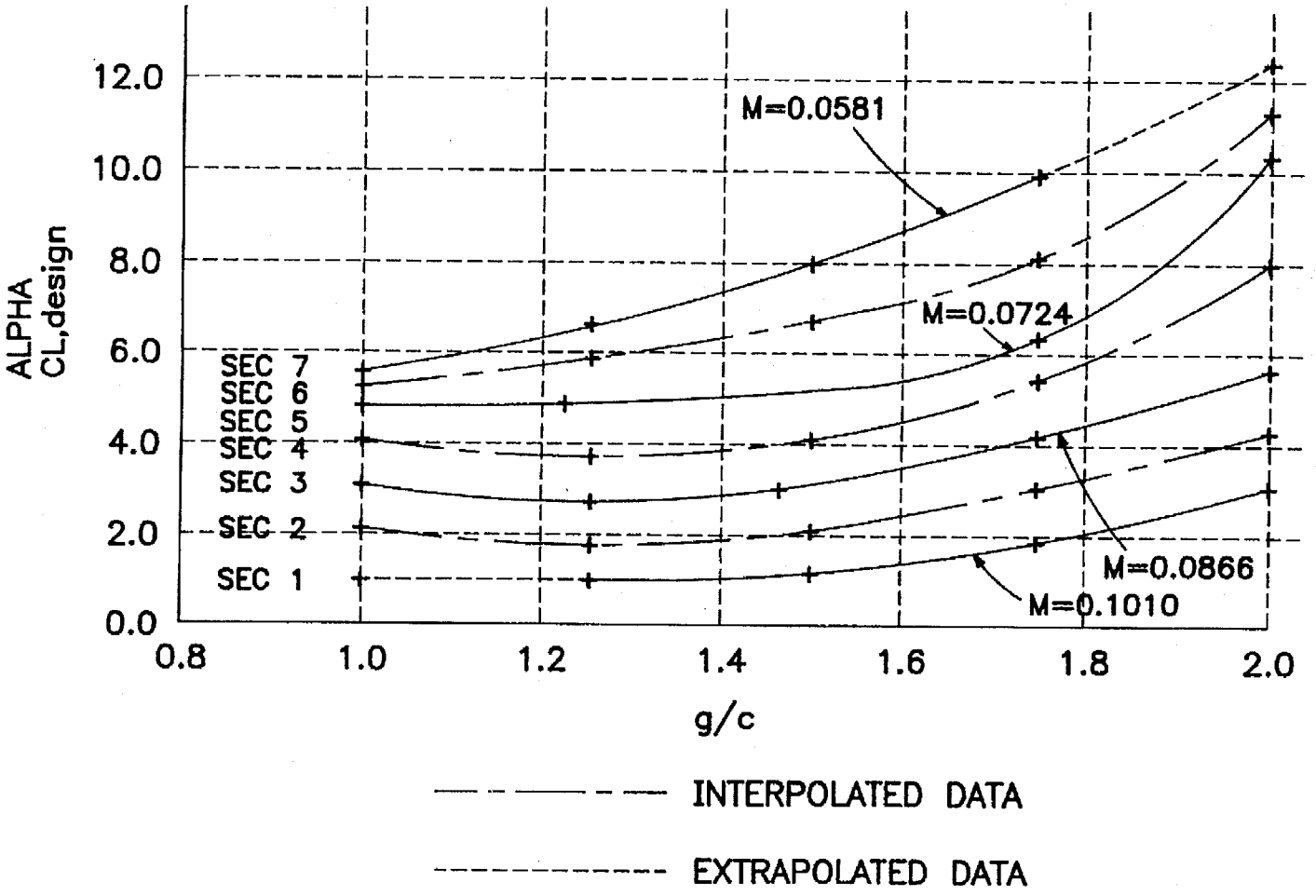
FIG. 10 is a graph of angle of attack at the design lift coefficient, $\alpha CL$,design, as a function of gap-to-chord ratio, g/c, illustrating curves generated for seven airfoil sections from the blade tip to near the blade root.

A commercially available, two-dimensional, airfoil/cascade analysis program called MISES was used to predict airfoil loading as a function of gap-to-chord ratio and onset flow velocity. See M. Drela & H. Youngren, "A User's Guide to MISES 2.1," MIT Computational Aerospace Sciences Laboratory (June 1995). The plot of FIG. 10 shows angle of attack at the design lift coefficient, αCL,design, as a function of gap-to-chord ratio, g/c. Curves were generated for seven airfoil sections, from tip 18 (see the curve labeled "SEC 1") to near root 16 (see the curve labeled "SEC 7"). Inlet Mach numbers (M) range from 0.1010 (tip) to 0.0581 (near hub). In general, higher angles of attack are required for larger gap-to-chord ratios; for a constant g/c, angle of attack increases with decreasing Mach number.

The design procedure is as follows. Consider an arbitrary airfoil "m" located at radius "r" on blade "n" of the unequally spaced blade set. The gap is calculated by the following equation:

$$\bar{g}_n(r)=r\overline{\Delta\theta}_n.$$

For the unequally spaced blade arrangement, the gap between adjacent blades n and n+1 is different from the gap between blades n and n−1. An exception is blade n=1 of the nine-blade fan assembly 10 of FIG. 6. Here the spacing angle (theta, θ) between blades 1 and 2 and the spacing angle between blades 1 and 9 are equal, 35.7°. In all other cases, the average gap must be calculated using the average angle between adjacent blades:

$$\overline{\Delta\theta}_n=(0.5)(\theta_{n+1}+\theta_{n-1}).$$

For example, $\overline{\Delta\theta}_n$ of blade n=2 in FIG. 6 is (0.5) (35.7°+40.9°) or 38.3°. Calculate $\bar{g}_n/c$ using the local chord, c(r), at station "m."

For a given airfoil section "m" on blade n, calculate the blade-relative inlet Mach number, and use FIG. 10 to find the value of αCL,design at the known $(g_{avg})_{m,n}/c$. Record the value of αCL,design (unequally spaced). For this same airfoil "m" and blade n, use the plot of FIG. 10 to determine the value of αCL,design for the equally spaced blade arrangement. This requires calculation of blade gap for equally spaced blades, or:

$$g_{eq}=r\theta_{eq}.$$

For example, the blade spacing angle for the nine-blade fan of FIG. 1 is 40°, or 0.698 radius; $g_{eq}$=0.698r. Note that $g_{eq}$ is not a function of blade number, n, since $\theta_{eq}$ is a constant for equally spaced blades.

The reference value of αCL,design for equally spaced blades is found by entering the plot of FIG. 10 at $g_{eq}/c$ and the Mach number for station "m." Record this value as αCL,design (equally spaced). Subtract αCL,design (equally spaced) from αCL,design (unequally spaced):

$$(\Delta\alpha CL,design)_{m,n}=(\alpha CL,design(uneq.\ spaced)_{m,n}-(\alpha CL,design(eq.\ spaced))_{m,n}.$$

This is the adjustment angle needed to restore the performance of this airfoil (at one section, m, and one blade, n) to that of an airfoil in an equally spaced blade arrangement.

For a given radial station, this calculation must be repeated for each of the "N" unequally spaced blades. For example, at section m=1 (tip airfoil at r=170.0 mm, c=60.57 mm) of the unequally spaced blades of FIG. 6, ΔαCL,design must be calculated for each of nine blades:

SEC m = 1 r = 170.0 mm c = 60.57 mm

| Blade No. (n) | $\overline{\Delta\theta}_n$ | $\bar{g}_n$ | $\bar{g}_n/c$ | $(\Delta\alpha_{CL,\ design})_{1,n}$ |
|---|---|---|---|---|
| 1 | 35.7° | 105.92 | 1.75 | −0.72° |
| 2 | 38.3° | 113.64 | 1.88 | −0.40 |
| 3 | 45.0° | 133.52 | 2.20 | +0.64 |
| 4 | 43.05° | 127.73 | 2.11 | +0.40 |
| 5 | 35.8° | 106.22 | 1.75 | −0.72 |
| 6 | 35.8° | 106.22 | 1.75 | −0.72 |
| 7 | 43.05° | 127.73 | 2.11 | +0.40 |
| 8 | 45.0° | 133.52 | 2.20 | +0.64 |
| 9 | 38.3° | 113.64 | 1.88 | −0.40 |

This table must be generated for each section (m=1, . . . , 7) (i.e., from tip to near hub). The term $(\Delta\alpha CL,design)_n$ is calculated for each blade, n, as follows:

$$(\Delta\alpha_{CL,design})_n=\frac{1}{M}\sum_{m=1}^{M}(\Delta\alpha_{CL,design})_{m,n},$$

where $(\Delta\alpha CL,design)_{m,n}$ is the value of ΔαCL,design of blade n (n=1, . . . , N) at section m (m=1, . . . , M). For the fan of FIG. 6, N=9 blades; the number of sections (tip to near hub) is M=7. These numbers apply only to this example; other numbers of blades (N) and sections (M) may be used.

The n values of $(\Delta\alpha CL,design)_n$ are added to the baseline (equally spaced) blade setting angle $\beta_n$ for each of the n (n=1, . . . , N) blades:

$$\beta_n=(\gamma_n+\alpha_n)+(\Delta\alpha CL,design)n.$$

Note that $(\Delta\alpha CL,design)_n$ is a setting adjustment averaged over "m" sections. This is a compromise measure that allows one blade to be copied to several positions around the circumference of the hub and set to a unique setting angle. Tooling costs are thereby minimized.

The chart below shows the addition of adjustment angles $(\Delta\alpha CL,design)_n$ to the baseline setting angle of the nine-blade fan assembly illustrated in FIG. 6. The unequally spaced blades 100 each had an original tip setting angle of 17.5°, as shown in FIG. 9.

| Blade No. (n) | $(\Delta\alpha_{CL,design})_n$ | $\beta_{n(tip)}$ |
|---|---|---|
| 1 | −0.29 | 17.2 |
| 2 | −0.16 | 17.4 |
| 3 | +0.66 | 18.2 |
| 4 | +0.39 | 17.9 |
| 5 | −0.29 | 17.2 |
| 6 | −0.29 | 17.2 |
| 7 | +0.39 | 17.9 |
| 8 | +0.66 | 18.2 |
| 9 | −0.16 | 17.4 |

The "unwrapped" tip airfoils of the nine unequally spaced blades (FIG. 6), with the setting angles given above, are shown in FIG. 11.

As an alternative to the compromise measure discussed above, several unique blades—each with its own distribution of setting angles from tip to hub—might be provided. Each unique blade would be designed using the data of FIG. 10 to determine the ΔαCL,design for each section of the blade. This might result in four or five unique blades, for the nine-blade balanced fan assembly illustrated in FIG. 6, depending upon the spacing angles. The advantage of this alternative is more uniform loading for each blade throughout the entire span.

A prototype fan assembly 10 was built with the unequal blade spacing angles of fan assembly 10 shown in FIG. 6. Blades 100 were attached to an aluminum hub 12; blades 100 rested in cylindrical hub sockets, allowing blade setting angles to be easily and accurately changed. Fan assemblies 10 were tested with both equal setting angles (tip setting angles of 17.5°) and unequal setting angles (from the chart above).

Figure 12:
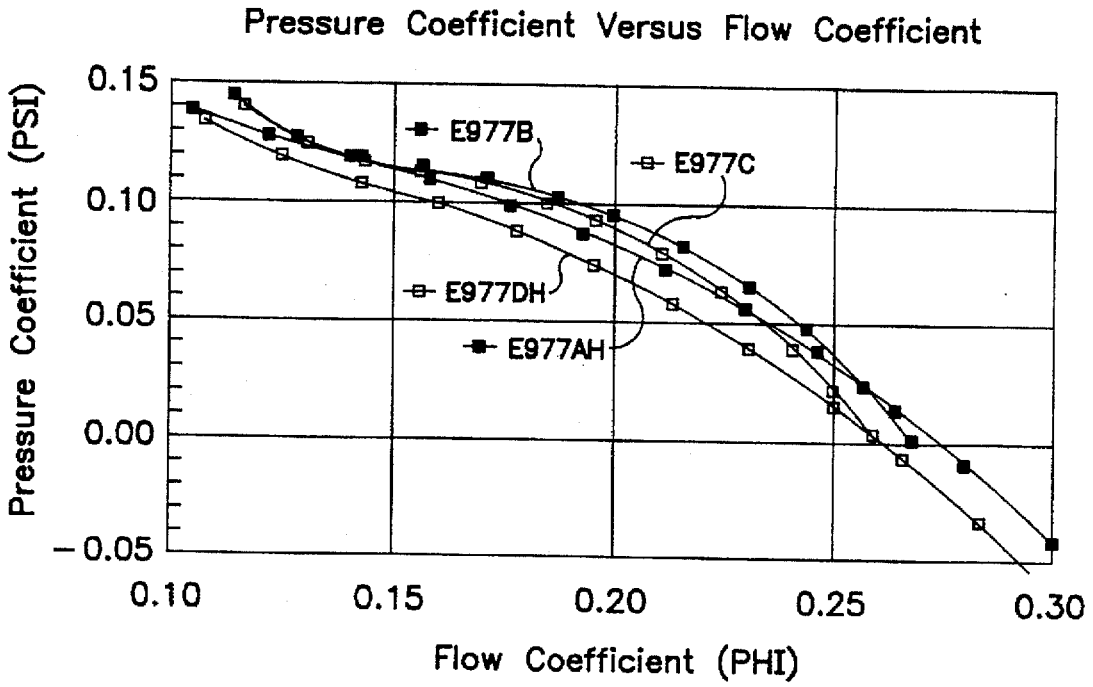
FIG. 12 is a graph of pressure coefficient versus flow coefficient comparing fan assemblies having equal and unequal blade setting angles, both having the unequal blade spacing angles of the fan assembly illustrated in FIG. 6, when tested under two conditions.
Figure 13:
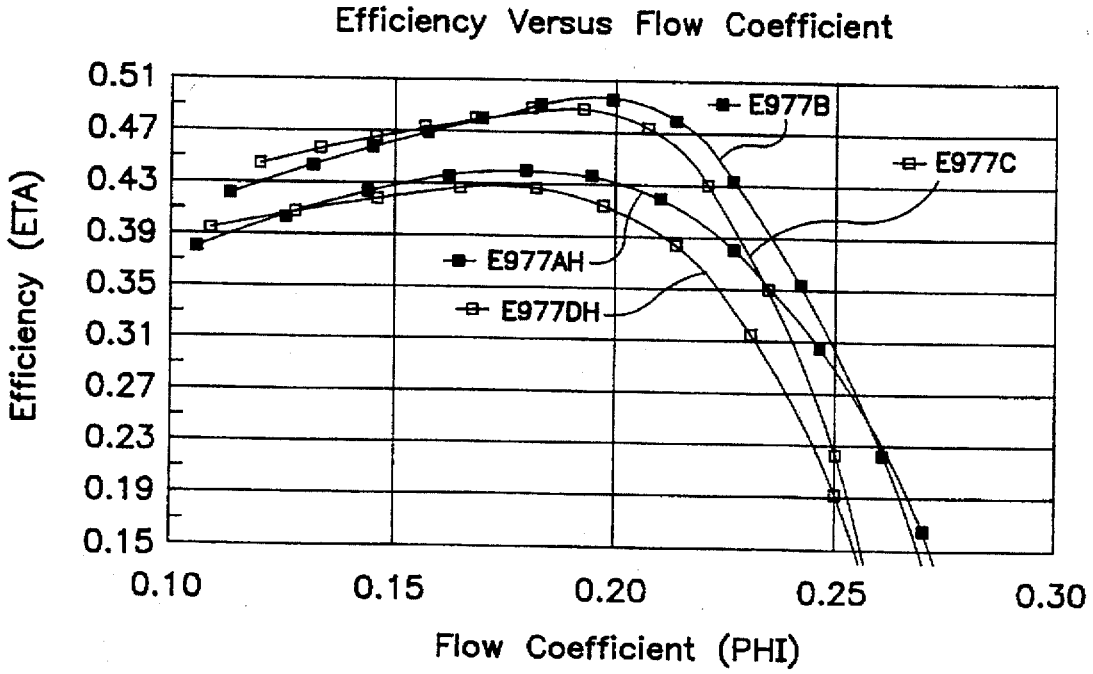
FIG. 13 is a graph of efficiency versus flow coefficient comparing fan assemblies having equal and unequal blade setting angles, both having the unequal blade spacing angles of the fan assembly illustrated in FIG. 6, when tested under two conditions.

Test results are shown in FIGS. 12 and 13. Each of the two fan assemblies 10 were tested under two conditions: (a) with no upstream obstructions, and (b) with an upstream heat exchanger. The labels in FIGS. 12 and 13 correspond to the following test conditions:

E977AH: Unequal setting angles, upstream heat exchanger;

E977DH: Equal setting angles, upstream heat exchanger;

E977B: Unequal setting angles, no upstream obstruction; and

E977C: Equal setting angles, no upstream obstruction.

The test data show both increased pumping (higher pressure rise at a given flow rate) s and increased maximum efficiency for the fan assembly 10 having unequal spacing angles and unequal setting angles, compared with the baseline fan assembly 10 with unequal spacing angles and equal setting angles.

In summary, fan assembly 10 of the present invention provides reduced noise tonality through the use of unequal blade spacing and improved flow performance through the use of unequal blade setting angles. A practical design procedure has been developed and that procedure has been validated via laboratory testing with a prototype fan assembly.

Figure 14:
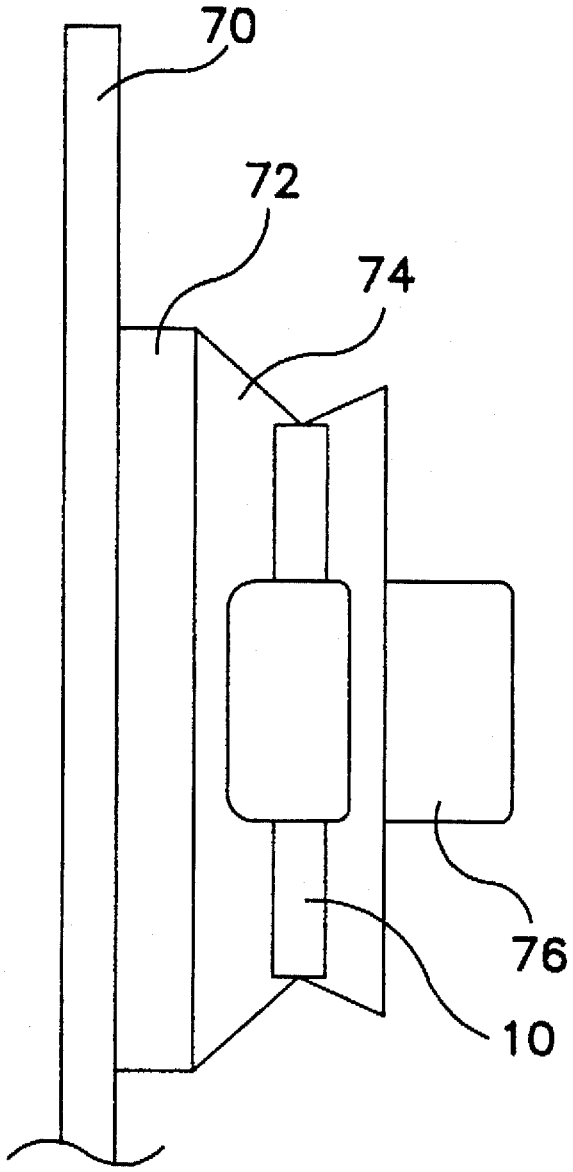
FIG. 14 illustrates the fan assembly of the present invention as assembled in a vehicle.

Fan assembly 10 of the present invention is shown assembled in a vehicle 70 in FIG. 14. Fan assembly 10 is located just behind or downstream of the radiator 72 of vehicle 70 and may be positioned in a shroud 74. Mechanical energy is imparted to fan assembly 10 from an electric motor, a hydraulic motor, or some other power source 76.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A vehicle fan assembly for circulating air to cool an engine, said fan assembly comprising:

a central hub;

a plurality of blades disposed circumferentially around and extending radially outward from said central hub between a blade root joined to said central hub and a blade tip with a blade span formed between said root and said tip;

unequal spacing angles by which said blades are spaced circumferentially from each other around said central hub, said unequal spacing angles minimizing noise produced by said fan assembly; and unequal setting angles by which said blades are positioned at a radial location along a blade span, said unequal setting angles increasing the maximum efficiency of said fan assembly.

2. A vehicle fan assembly as claimed in claim 1 wherein said blades have a straight planform.

3. A vehicle fan assembly as claimed in claim 1 wherein said blades have a curved planform.

4. A vehicle fan assembly as claimed in claim 1 further comprising means for imparting mechanical energy to said fan assembly.

5. A vehicle fan assembly as claimed in claim 1 wherein said imparting means is an electric motor.

6. A vehicle fan assembly as claimed in claim 1 wherein said imparting means is an hydraulic motor.

7. A vehicle fan assembly for circulating air to cool an engine, said fan assembly comprising:

a central hub;

a plurality of blades disposed circumferentially around and extending radially outward from said central hub between a blade root joined to said central hub and a blade tip with a blade span formed between said root and said tip;

unequal spacing angles by which said blades are spaced circumferentially from each other around said central hub, said unequal spacing angles minimizing noise produced by said fan assembly;

unequal setting angles by which said blades are positioned at a radial location along a blade span, said unequal setting angles increasing the maximum efficiency of said fan assembly; and one of an electric motor and a hydraulic motor imparting mechanical energy to said fan assembly.

8. A vehicle fan assembly as claimed in claim 7 wherein said blades have a straight planform.

9. A vehicle fan assembly as claimed in claim 7 wherein said blades have a curved planform.

10. A process for designing a vehicle fan assembly circulating air to cool an engine and having a central hub and a plurality of blades disposed circumferentially around and extending radially outward from said central hub between a blade root joined to said central hub and a blade tip with a blade span formed between said root and said tip, said process comprising:

(a) determining the unequal spacing angles, by which said blades are spaced circumferentially from each other around said central hub, required to minimize noise produced by said fan assembly;

(b) calculating velocity triangles for each of several radial sections along said span of each blade of said fan assembly;

(c) optimizing, from the velocity triangles, the setting angles required at each radial section along said span of each blade to produce substantially equal loading on each blade of said fan assembly; and (d) positioning said blades of said fan assembly at the determined unequal blade spacing angles and optimized unequal blade setting angles.

* * * * *